US008189017B2

(12) United States Patent
Chung et al.

(10) Patent No.: US 8,189,017 B2
(45) **Date of Patent: *May 29, 2012**

(54) APPARATUS AND METHOD FOR CONTROLLING PICTURE QUALITY OF FLAT PANEL DISPLAY

(75) Inventors: In Jae Chung, Gwacheon-si (KR); Ji Kyoung Kim, Seoul (KR); Jong Hee Hwang, Osan-si (KR)

(73) Assignee: LG Display Co., Ltd., Seoul (KR)

( * ) Notice: Subject to any disclaimer, the term of this patent is extended or adjusted under 35 U.S.C. 154(b) by 1184 days.

This patent is subject to a terminal disclaimer.

(21) Appl. No.: 12/003,788

(22) Filed: Dec. 31, 2007

(65) Prior Publication Data

US 2008/0238911 A1 Oct. 2, 2008

(30) Foreign Application Priority Data

Mar. 29, 2007 (KR) ..... 10-2007-0030971

(51) Int. Cl.
*G09G 5/02* (2006.01)

(52) U.S. Cl. ..... 345/694; 345/596; 345/598; 345/690; 345/691; 345/696; 348/574

(58) Field of Classification Search ..... 345/598, 345/599, 696; 348/574
See application file for complete search history.

(56) References Cited

U.S. PATENT DOCUMENTS 7,889,188 B2 * 2/2011 Hwang ..... 345/204

* cited by examiner

*Primary Examiner* — Antonio A Caschera
(74) *Attorney, Agent, or Firm* — McKenna Long & Aldridge, LLP

(57) ABSTRACT

An apparatus and method for controlling picture quality of a flat panel display. The apparatus for controlling picture quality of the flat panel display includes a position determining unit which determines a display position of digital video data; a gray-level determining unit which determines a gray-level value of the digital video data; and a frame rate control unit that disperses a plurality of dither patterns determined by a compensation value for compensating for brightness in a boundary between the panel defect region and the non-defect region during a plurality of frame periods and controls data, which will be displayed in the boundary, by the compensation value, if the digital video data is determined to the data which will be displayed in the boundary between the panel defect region and the non-defect region according to the determined result of the position determining unit.

9 Claims, 25 Drawing Sheets

FIG. 10

| | | | |
|---|---|---|---|
| $X^1/8$ | $X^1/8$ | $X^1/8$ | $X^1/8$ |
| $X^2/8$ | $X^2/8$ | $X^2/8$ | $X^2/8$ |
| $X^3/8$ | $X^3/8$ | $X^3/8$ | $X^3/8$ |
| $X^4/8$ | $X^4/8$ | $X^4/8$ | $X^4/8$ |

[4n+1 Frame]

| | | | |
|---|---|---|---|
| $X^2/8$ | $X^2/8$ | $X^2/8$ | $X^2/8$ |
| $X^3/8$ | $X^3/8$ | $X^3/8$ | $X^3/8$ |
| $X^4/8$ | $X^4/8$ | $X^4/8$ | $X^4/8$ |
| $X^1/8$ | $X^1/8$ | $X^1/8$ | $X^1/8$ |

[4n+2 Frame]

| | | | |
|---|---|---|---|
| $X^3/8$ | $X^3/8$ | $X^3/8$ | $X^3/8$ |
| $X^4/8$ | $X^4/8$ | $X^4/8$ | $X^4/8$ |
| $X^1/8$ | $X^1/8$ | $X^1/8$ | $X^1/8$ |
| $X^2/8$ | $X^2/8$ | $X^2/8$ | $X^2/8$ |

[4n+3 Frame]

| | | | |
|---|---|---|---|
| $X^4/8$ | $X^4/8$ | $X^4/8$ | $X^4/8$ |
| $X^1/8$ | $X^1/8$ | $X^1/8$ | $X^1/8$ |
| $X^2/8$ | $X^2/8$ | $X^2/8$ | $X^2/8$ |
| $X^3/8$ | $X^3/8$ | $X^3/8$ | $X^3/8$ |

[4n+4 Frame]

APPARATUS AND METHOD FOR CONTROLLING PICTURE QUALITY OF FLAT PANEL DISPLAY

This application claims the benefit of Korean Patent Application No. P2007-30971, filed on Mar. 29, 2007, which is hereby incorporated by reference for all purposes as if fully set forth herein.

BACKGROUND OF THE INVENTION

1. Field of the Invention

The present invention relates to a flat panel display, and more particularly, to an apparatus and method for controlling picture quality of a flat panel display, which are capable of increasing the periodicity of dither patterns to prevent a boundary from appearing between adjacent dither patterns having different compensation values and suppressing FRC flicker.

2. Discussion of the Related Art

Flat panel display devices are light in weight and can be made small in size compared with cathode ray tube displays. Examples of flat panel displays include a liquid crystal display, a field emission display, a plasma display panel and an organic light emitting diode display.

Examples of methods for finely controlling picture quality of the flat panel displays include error diffusion, dithering, and frame rate control (FRC).

FIG. 1 is a view showing an example of the FRC method in which data is supplied to any one pixel during four frame periods.

FRC temporally disperses a compensation value and corrects a gray level of original data with a gray level smaller than the compensation value.

In order to represent a gray level higher than the gray level of input data by a ¼ gray level, in the FRC, as shown in FIG. 1A, "1" is added to the input data during one frame period, in bit digital data which will be displayed in the same pixel during the four frame periods. One frame period is the time used for displaying a first line to a last line of a screen, and is 1/60 sec in a national television system committee (NTSC) standard, and is 1/50 sec in a phase alternation line (PAL) standard. In order to represent a gray level higher than the gray level of the input data by a ½ gray level, in the FRC, as shown in FIG. 1B, "1" is added to the input data during two frame periods, in bit digital data which will be displayed in the same pixel during the four frame periods. In order to represent a gray level higher than the gray level of the input data by a ¾ gray level, in the FRC, as shown in FIG. 1C, "1" is added to the input data during three frame periods, in bit digital data which will be displayed in the same pixel during the four frame periods.

Dithering spatially disperses a compensation value and corrects the gray level of original data with a gray level smaller than the compensation value. As shown in FIG. 2, a gray-level value added to original data is determined by the number of pixels to which a compensation value "1" is added in a unit window including a plurality of pixels. For example, the number of pixels, to which the compensation value "1" is added in four pixels, in a ¼ dither pattern shown in (a) of FIG. 2, the number of pixels, to which the compensation value "1" is added in four pixels, is two in a ½ dither pattern shown in (b) of FIG. 2, and the number of pixels, to which the compensation value "1" is added in four pixels, is three in a ¾ dither pattern shown in (c) of FIG. 2.

A combination of FRC and dithering may be applied. For example, in the FRC, various types of dither patterns shown in FIG. 3 are dispersed in the unit of a frame period. FIG. 3 shows an example of the FRC using the dither patterns shown in FIG. 2. However, in the FRC, small-sized pixels, to which the compensation value is applied, are uniformly arranged in the same dither pattern. If the same dither pattern is repeated during several frame periods, a variation in brightness between dither patterns having different compensation values may be increased. As a result, periodic noise appears in the displayed screen.

FIG. 4 is a view showing an example of display unevenness that occurs when data having the same gray level is supplied to a liquid crystal display panel, due to a defect of the panel. In FIG. 4, a portion of the liquid crystal display panel denoted by a dotted ellipse indicates a portion in which darkness is increased toward a right side when displaying data having the same gray level. In order to uniformly correct the brightness in a panel defect region, compensation values are added to data during several frames by the FRC using dither patterns of which the compensation values are increased toward the right side. As shown in FIG. 4, in a related art FRC, the size of the dither pattern may be as small as 8 pixels×8 pixels, and the pixels to which the compensation value is added are the same in the dither patterns having the same compensation value, and the same dither pattern is vertically and horizontally repeated with a small period. Accordingly, the brightness is rapidly changed in a boundary between the dither patterns as denoted by a blue curve and a thin bright line or black line may be displayed in the boundary when the compensation is performed stepwise according to a dither pattern having a predetermined size.

FIGS. 5A to 5C show examples of a picture-quality defect region. FIG. 5A shows a thin oblique-line pattern, FIG. 5B shows a thin horizontal-line pattern, and FIG. 5C shows a thin vertical-line pattern. Patterns such as those shown in FIGS. 5A to 5C are generated because, when the same dither pattern is horizontally and vertically repeated with the small period, the compensation values are not temporally/spatially dispersed in the dither patterns and a data bunching phenomenon occurs in a specific pattern.

Such a data bunching phenomenon may cause a horizontal-line pattern shown in FIG. 6 or FRC flicker shown in FIGS. 7A and 7B, according to the gray level of the data.

FIG. 6 shows a dither pattern having a gray level of 4n+2 (where n is a natural number including 0). As shown, if the polarities of data in the dither pattern are inverted by a vertical 2-dot inversion method, brightness is slightly increased by the compensation value having the same polarity and having a diagonal pattern shape. Thus, a thin oblique-line pattern appears and a color band having two horizontal-line patterns appears.

FIGS. 7A and 7B show dither patterns having gray levels of 4n+1 and 4n+3, respectively, As shown, if the polarities of data in the dither pattern are inverted by a vertical 2-dot inversion method, the increase in brightness due to the compensation value varies with a period of two frame resulting in a FRC flicker phenomenon.

SUMMARY OF THE INVENTION

Accordingly, the present invention is directed to an apparatus and method for controlling picture quality of a flat panel display that substantially obviate one or more problems due to limitations and disadvantages of the related art.

An advantage of the present invention is to provide an apparatus and method for controlling picture quality of a flat panel display using FRC, which are capable of increasing the periodicity of dither patterns so as to prevent a boundary from appearing between adjacent dither patterns having different compensation values.

Another advantage of the present invention is to provide an apparatus and method for controlling picture quality of a flat panel display using FRC, which are capable of increasing the periodicity of dither patterns so as to suppress FRC flicker.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for controlling picture quality of a flat panel display including a panel defect region and a non-defect region is provided, the apparatus including: a position determining unit which determines a display position of digital video data; a gray-level determining unit which determines a gray-level value of the digital video data; and a FRC control unit which disperses a plurality of dither patterns determined by a compensation value for compensating for brightness in a boundary between the panel defect region and the non-defect region during a plurality of frame periods and controls data, which will be displayed in the boundary, by the compensation value, if the digital video data is determined to the data which will be displayed in the boundary between the panel defect region and the non-defect region according to the determined result of the position determining unit.

Each of the plurality of dither patterns may include a plurality of sub dither patterns.

The compensation value of each of the dither patterns may be equal to that of each of the sub dither patterns included in each of the dither patterns.

The sub dither patterns included in each of the dither patterns may be different from one another in the positions of compensation pixels.

If the compensation value is "I" and the number of sub dither patterns is "J", the dither pattern having the compensation value of "I" may include J sub dither patterns which have the compensation value of "I" and are different from one another in the positions of the compensation pixels, and the arrangements of the sub dither patterns may be different in J frames.

The arrangements of the sub dither patterns may be vertically shifted in each of frames by frame rolling.

The arrangements of the sub dither patterns are equal in the unit of J frame periods.

Each of the dither patterns may have a size of 8 pixels×32 pixels or more.

The apparatus for controlling the picture quality of the flat panel display may further include a memory for storing the compensation value and positional data indicating pixel positions of the boundary.

The FRC control unit may disperse the compensation value to the plurality of compensation pixels and the frame periods according to the dither patterns and generate FRC data.

The apparatus for controlling the picture quality of the flat panel display may further include a calculator which adds/subtracts the FRC data to the data of the boundary.

The compensation value may vary according to the gray-level value of the data which will be displayed in the boundary.

In another aspect of the present invention, a method for controlling the picture quality of the flat panel display includes determining a compensation value for compensating for brightness in a boundary between the panel defect region and the non-defect region; determining a display position and a gray-level value of digital video data; dispersing a plurality of dither patterns determined by the compensation value during a plurality of frame periods and controlling data, which will be displayed in the boundary, by the compensation value, if the digital video data is determined to the data which will be displayed in the boundary between the panel defect region and the non-defect region.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings:

FIG. 10 is a view explaining frame rolling of first to fourth sub dither patterns;

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, embodiments of the present invention will be described with reference to FIGS. 8A to 17.

Figure 8A:
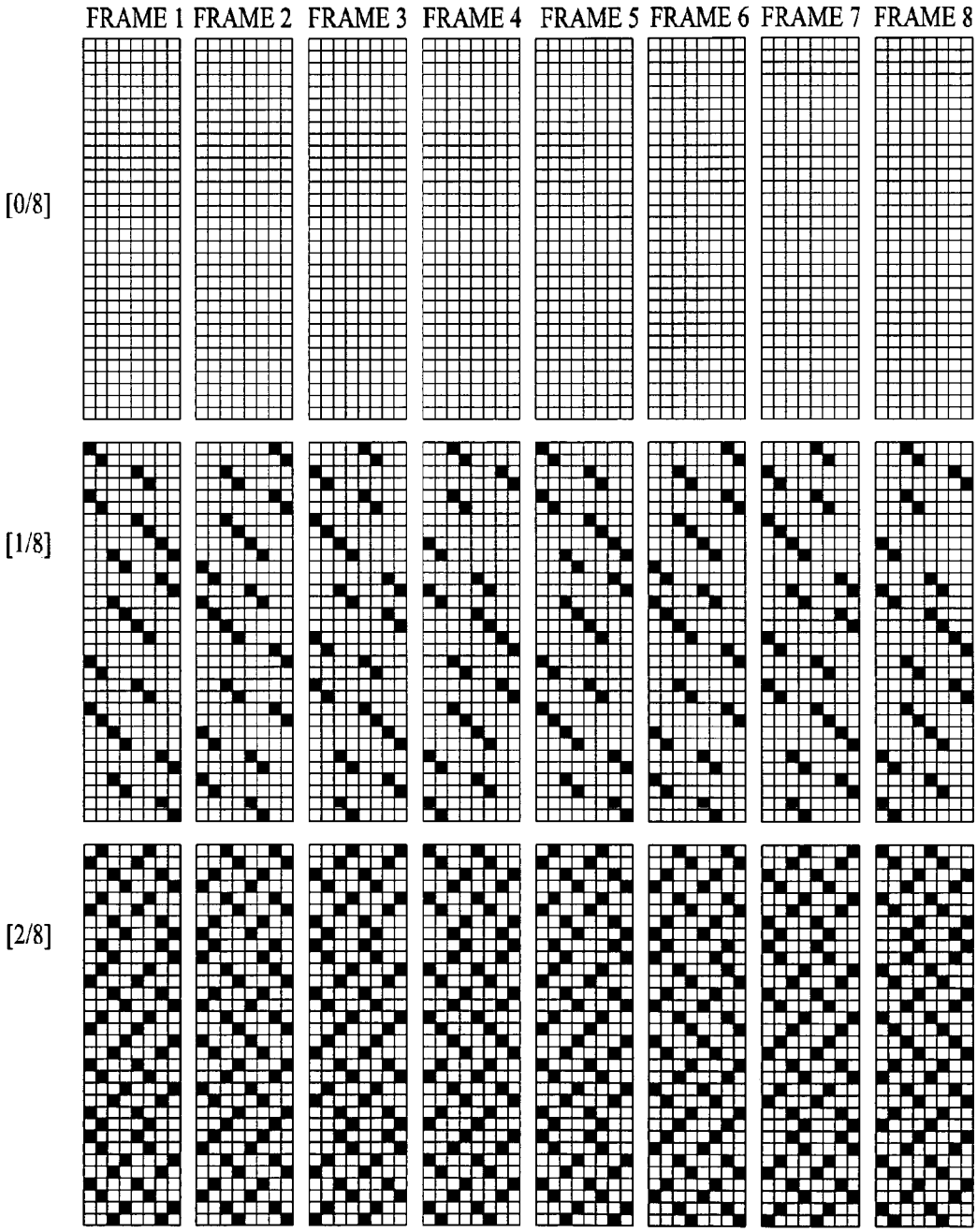
FIGS. 8A to 8C are views showing a dither pattern according to a first embodiment of the present invention.
Figure 8B:
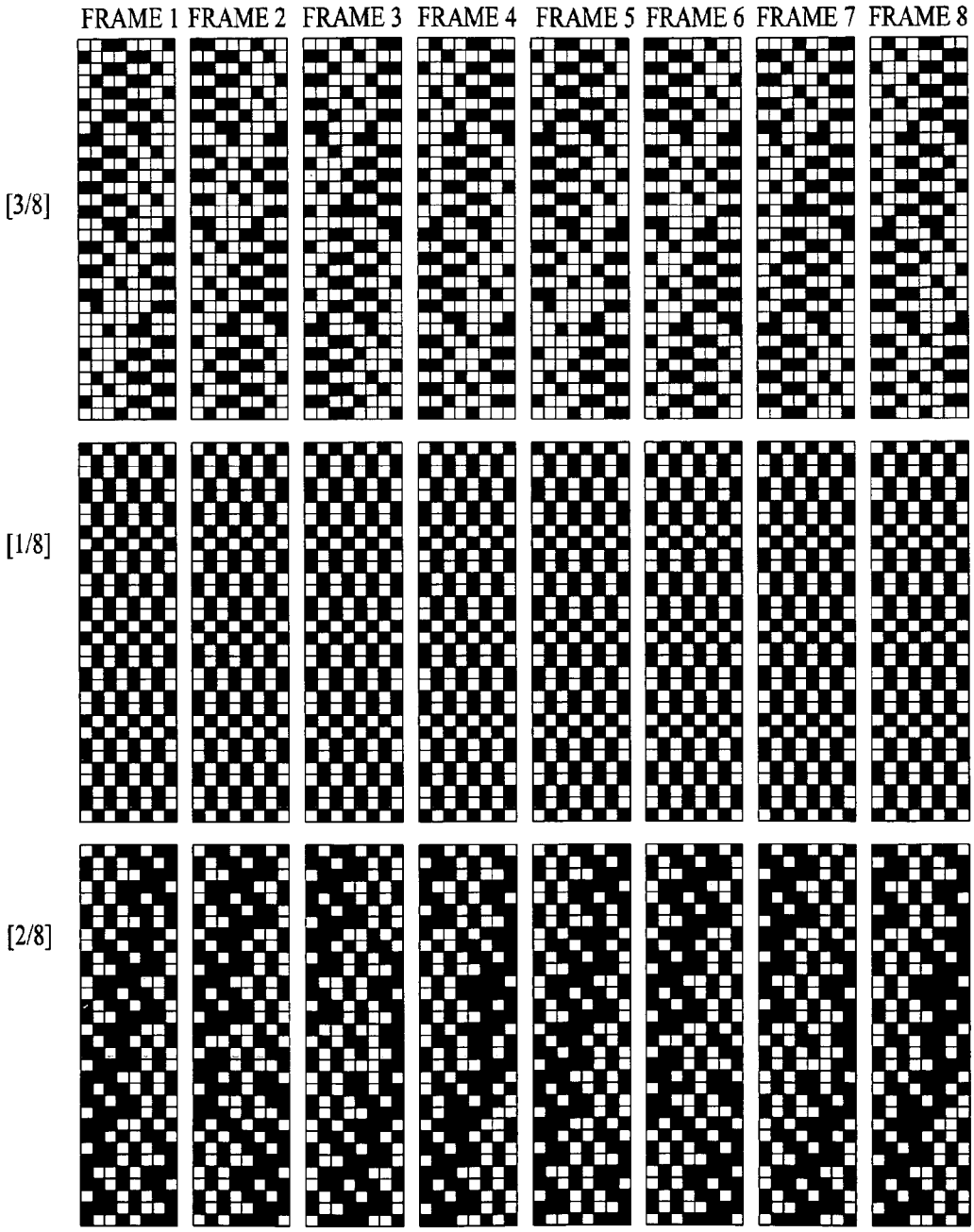
Figure 8C:
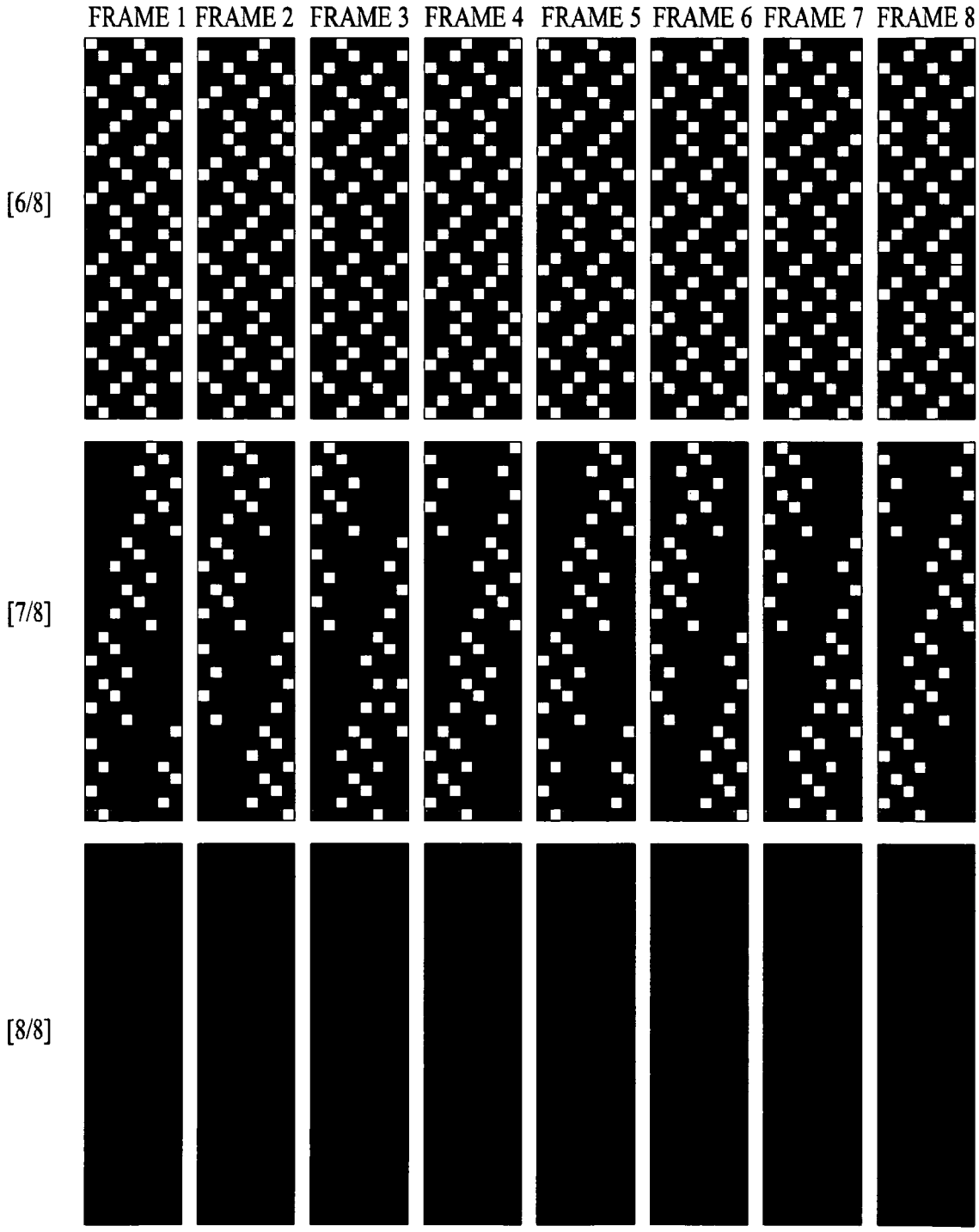

Referring to FIGS. 8A to 8C, in a method for controlling picture quality of a flat panel display according to a first embodiment of the present invention, compensation values "⅛", "⅜", "⅜", "⅜", "⅜", "⅜", "⅜" and "⅜(=1)" are added to or subtracted from input digital video data using dither patterns of 8 pixels×32 pixels. In the dither patterns, red pixels indicate pixels to/from which "1" is added/subtracted and gray pixels indicate pixels to/from which "0" is added/subtracted. The 8 pixels×32 pixels which is the size of each dither pattern is experimentally determined such that an observer cannot recognize a repetition period even when the same pattern is repeated and a boundary between the dither patterns representing different compensation values does not appear. Accordingly, in the present invention, dither patterns each having a size larger than 8 pixels×32 pixels, that is, dither patterns of 16 pixels×32 pixels, 24 pixels×32 pixels, 32 pixels×32 pixels, 16 pixels×40 pixels, or 16 pixels×44 pixels, may be used as the dither patterns representing the respective compensation values.

Each of the dither patterns includes four sub dither patterns which have the same compensation value and are different from one another in the positions of the pixels to/from which the compensation value is added/subtracted. For example, a dither pattern having a compensation value of "⅛" includes a first sub dither pattern having the compensation value of "⅛" shown in FIG. 9A, a second sub dither pattern having the compensation value of "⅛" shown in FIG. 9B, a third sub dither pattern having the compensation value of "⅛" shown in FIG. 9C, and a fourth sub dither pattern having the compensation value of "⅛" shown in FIG. 9D.

Figure 9A:
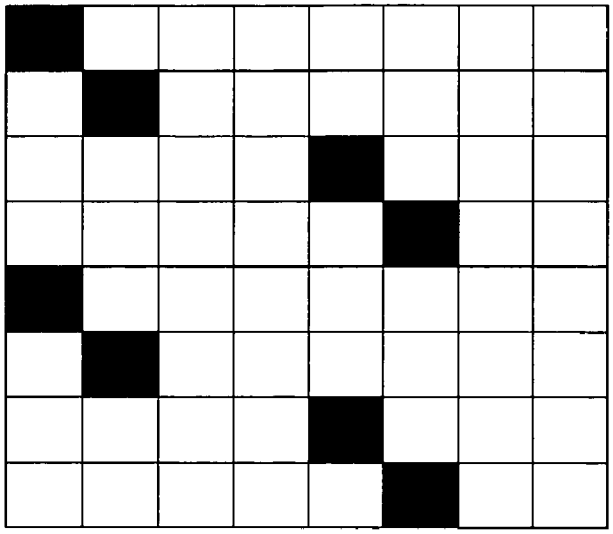
FIGS. 9A to 9D are views showing sub dither patterns of a ⅛ dither pattern shown in FIG. 8.
Figure 9B:
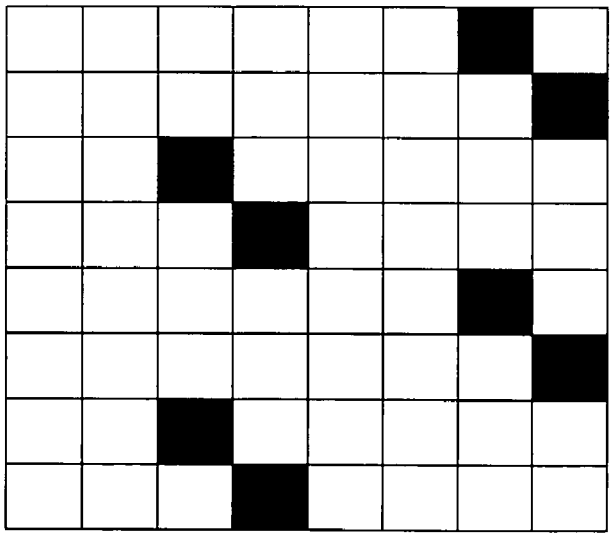
Figure 9C:
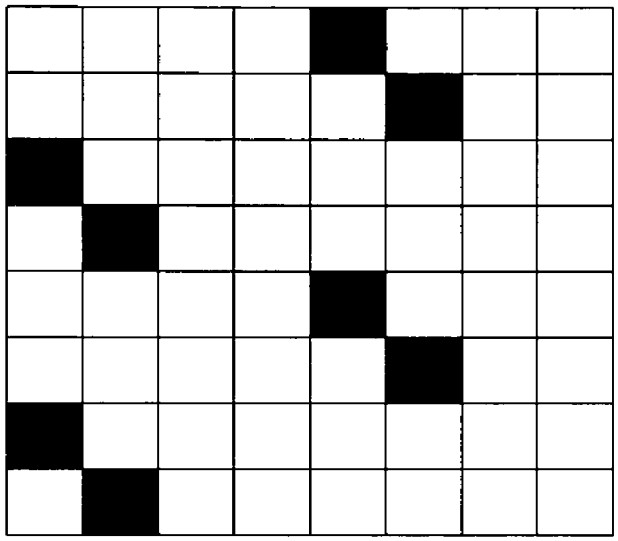
Figure 9D:
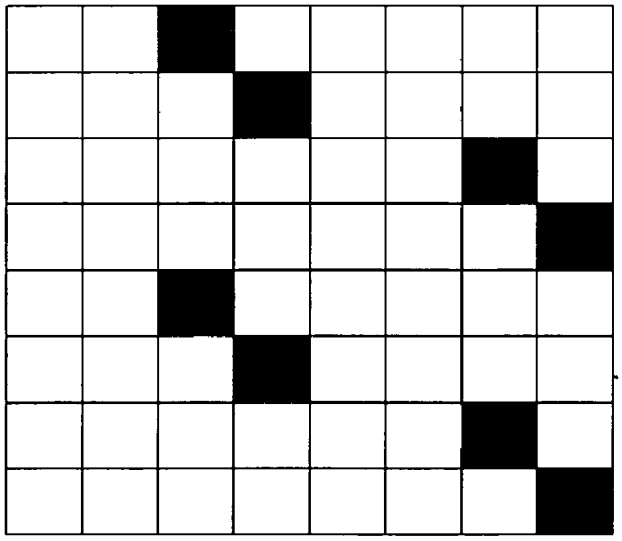

If x is a horizontal direction in which the order is increased from a left side to a right side one by one, y is a vertical direction in which the order is increased from a upper side to a lower side one by one, and a pixel, to which the compensation value is applied, is expressed by "P[x,y]", in the first sub dither pattern, the pixels to/from which the compensation value "1" is added/subtracted are P[1,1], P[1,5], P[2,2], P[2,6], P[5,3], P[5,7], P[6,4] and P[6,8] as shown in FIG. 9A. In the second sub dither pattern, the pixels to/from which the compensation value "1" is added/subtracted are P[3,3], P[3,7], P[4,4], P[4,8], P[7,1], P[7,5], P[8,2] and P[8,6] as shown in FIG. 9B. In the third sub dither pattern, the pixels to/from which the compensation value "1" is added/subtracted are P[1,3], P[1,7], P[2,4], P[2,8], P[5,1], P[5,5], P[6,2] and P[6,6] as shown in FIG. 9C. In the fourth sub dither pattern, the pixels to/from which the compensation value "1" is added/subtracted are P[3,1], P[3,5], P[4,2], P[4,6], P[7,3], P[7,7], P[8,4] and P[8,8] as shown in FIG. 9D.

In the dither pattern having the compensation value of "⅛" during a first frame period, the first sub dither pattern, the second sub dither pattern, the third sub dither pattern and the fourth sub dither pattern are arranged in this order from the top to the bottom and the positions of the pixels to/from which the compensation value is added/subtracted are shifted in each of the sub dither patterns in the horizontal/vertical direction such that the patterns of the pixels to/from which the compensation value is added/subtracted are not uniformly repeated in the horizontal/vertical direction. Such arrangement of the sub dither patterns varies according to a frame period, as shown in FIG. 8A. That is, in the dither pattern having the compensation value of "⅛" during a second frame period, the second sub dither pattern, the third dither pattern, the fourth dither pattern and the first dither pattern are arranged in this order from the top to the bottom and the positions of the pixels to/from which the compensation value is added/subtracted are shifted in the sub dither patterns in the horizontal/vertical direction. In the dither pattern having the compensation value of "⅛" during a third frame period, the third dither pattern, the fourth dither pattern, the first dither pattern and the second sub dither pattern are arranged in this order from the top to the bottom and the positions of the pixels to/from which the compensation value is added/subtracted are shifted in the sub dither patterns in the horizontal/vertical direction. In the dither pattern having the compensation value of "⅛" during a fourth frame period, the fourth dither pattern, the first dither pattern, the second sub dither pattern and the third dither pattern are arranged in this order from the top to the bottom and the positions of the pixels to/from which the compensation value is added/subtracted are shifted in the sub dither patterns in the horizontal/vertical direction. In the dither pattern having the compensation value of "⅛" during fifth and sixth frame periods, the dither pattern combinations used in first to fourth frame periods are repeated. FIG. 10 schematically shows this state. In FIG. 10, X⅛ denotes the first sub dither pattern, X⅜ denotes the second sub dither pattern, X⅜ denotes the third sub dither pattern, and X⅜ denotes the fourth sub dither pattern. As described above, the arrangement of the sub dither patterns is vertically rolled in each frame period so as to increase the periodicity of the dither patterns.

Similar to the dither pattern having the compensation value of "⅛", as shown in FIGS. 8A to 8C, if the compensation value is "I" and the number of sub dither patterns is "J", a ⅜ dither pattern, a ⅜ dither pattern, a ⅜ dither pattern, a ⅜ dither pattern, a ⅜ dither pattern and a ⅜ dither pattern includes J sub dither patterns that each have the compensation value "I" and are different from one another in the patterns of the pixels to/from which the compensation value is added/subtracted. The sub dither patterns have different arrangements in the J frames by frame rolling, and the sub dither patterns having the same arrangement appear with a period of J frames.

Figure 11:
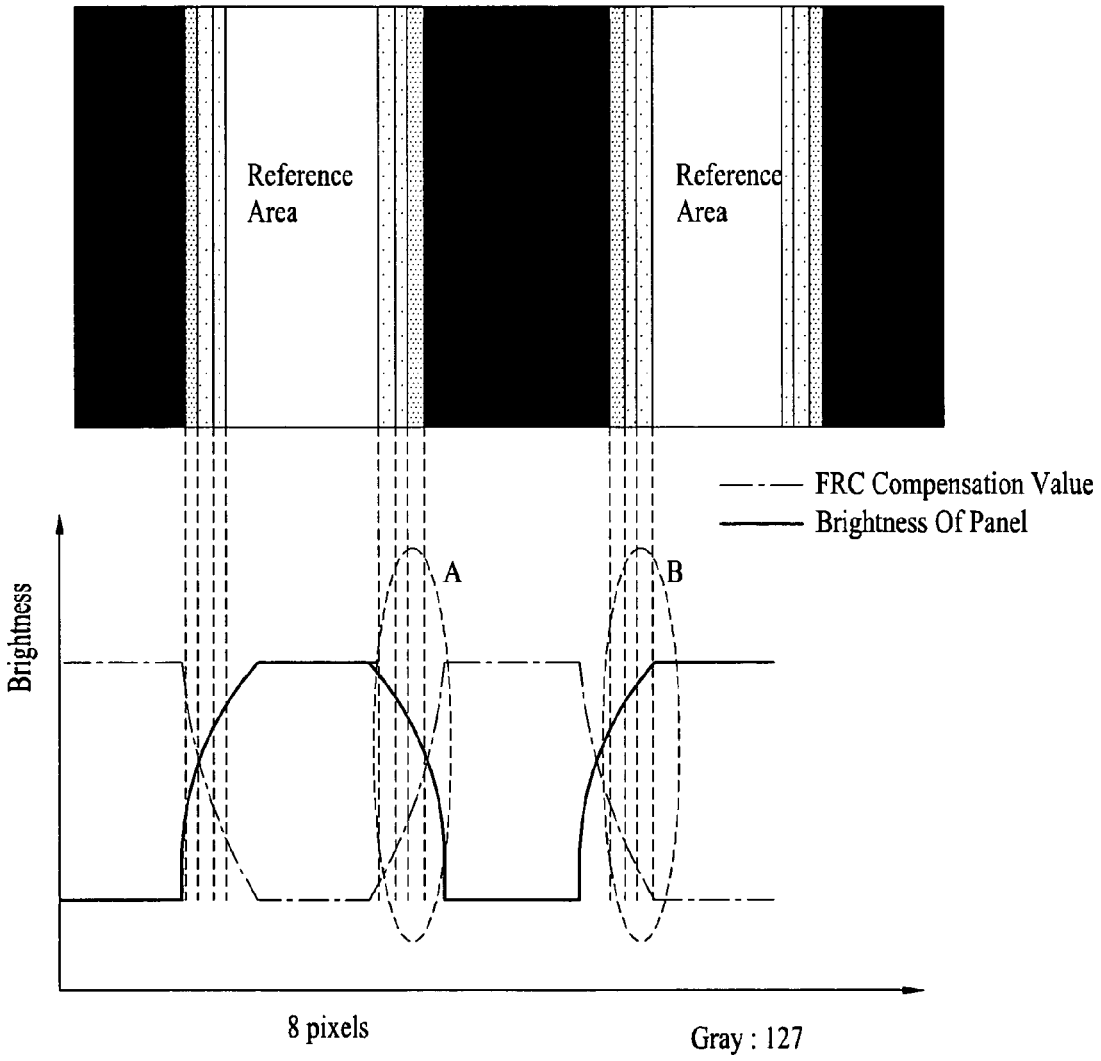
FIG. 11 is a view showing an example of a panel defect which occurs in a display panel and a compensation value for compensating for brightness of a panel defect region.

Meanwhile, due to a difference in exposure amount due to spherical aberration of a lens in an overlapping exposure process, a panel defect may occur as shown in FIG. 11. If the brightness of the panel is measured by supplying data having the same gray level to the panel and turning on the pixels, due to a failure of the exposure process, the brightness is decreased toward the right side in a boundary "A" between a panel defect region and a non-defect region, but the brightness is decreased toward the left side in a boundary "B" between the panel defect region and the non-defect region. In order to make the brightness in the boundary between the panel defect region and the non-defect region uniform, the data that will be displayed by pixels included in the panel defect region is modulated using an optimal compensation value including a predetermined decimal and the optimal compensation value is supplied to the panel, using a FRC compensation circuit. The FRC compensation circuit gradually increases the compensation value of the dither pattern toward the right side in order to compensate for a variation in brightness of the panel in the boundary "A" and gradually increases the compensation value of the dither pattern toward the left side in the boundary "B". The FRC compensation circuit will be described in detail later.

Figure 12:
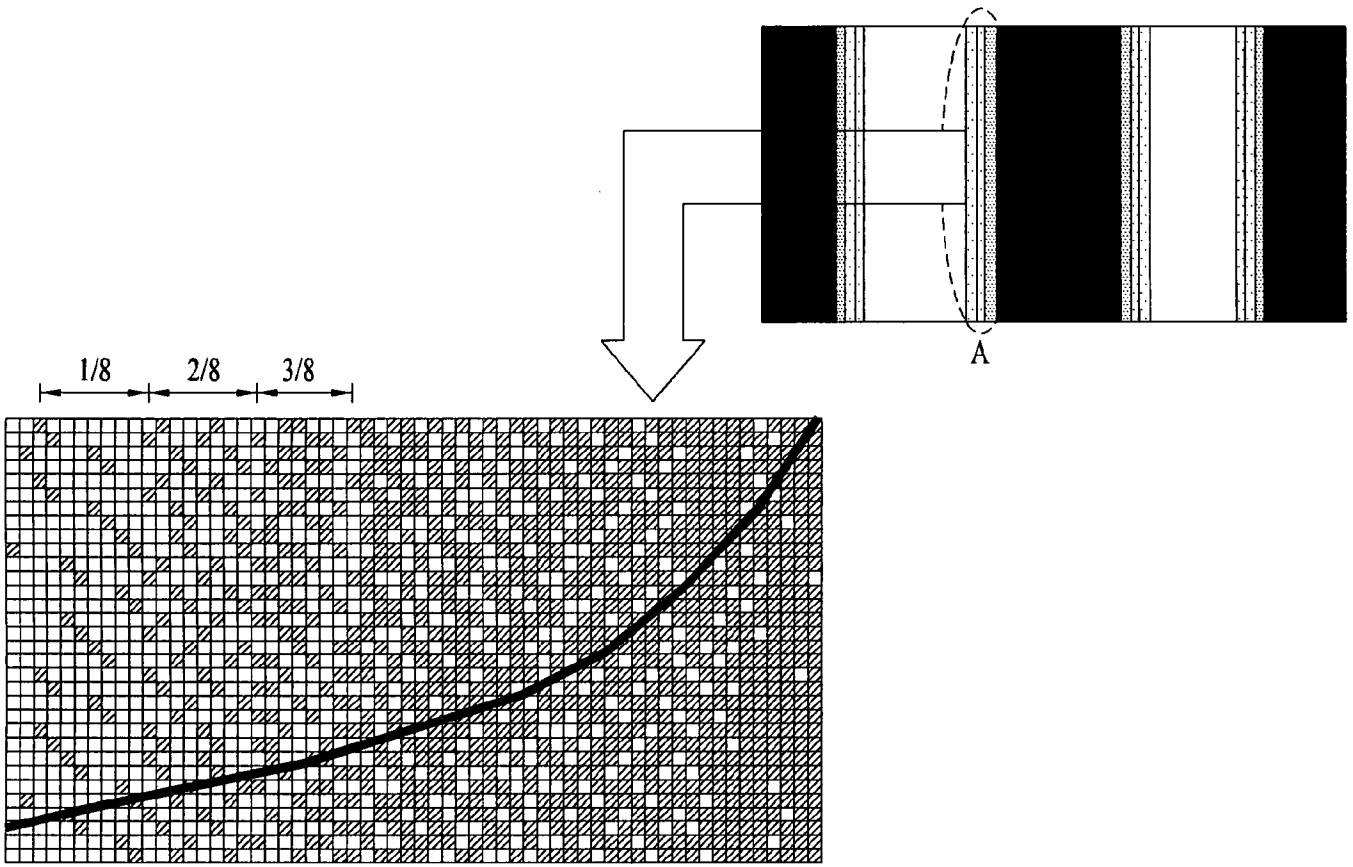
FIG. 12 is a view showing an example of a dither pattern applied to the panel defect region "A" shown in FIG. 11.

FIG. 12 is a view showing an example of adding the compensation value of the dither pattern to digital video data that will be displayed in the boundary "A" of FIG. 11, and compensating for the brightness of the boundary "A" so as to become equal to that of the non-defect region, in the first frame period, using the dither patterns shown in FIGS. 8A to 8C. As can be seen from FIG. 12, according to the FRC of the present invention the brightness in the boundary between the adjacent dither patterns having the different compensation values is rapidly changed.

Figure 13A:
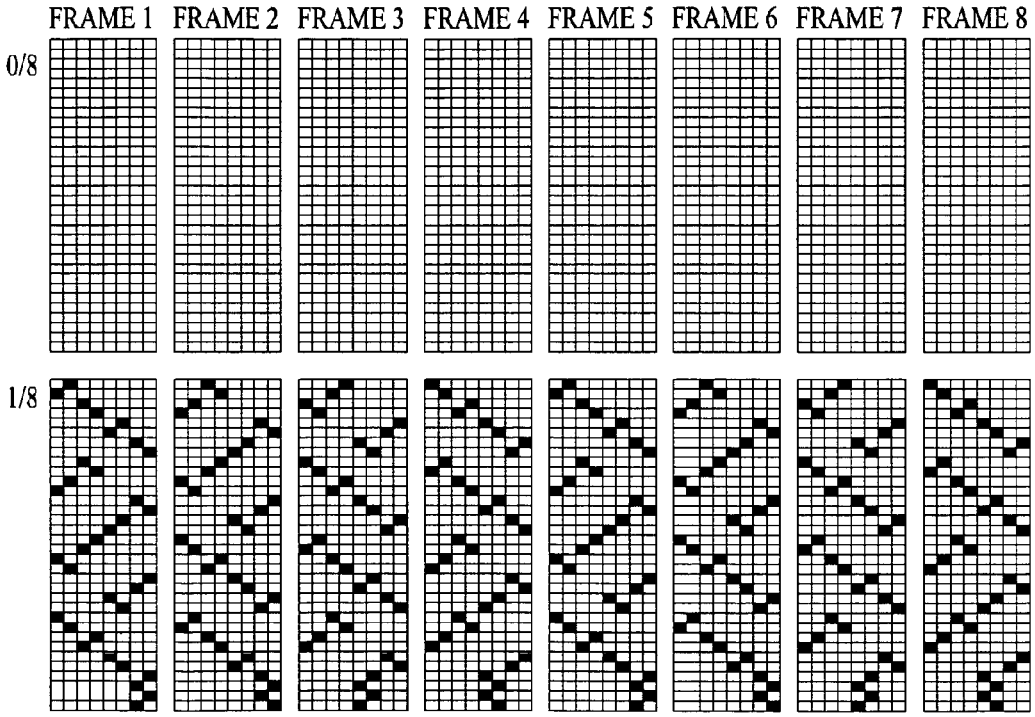
FIGS. 13A to 13D are views showing a dither pattern according to a second embodiment of the present invention.
Figure 13B:
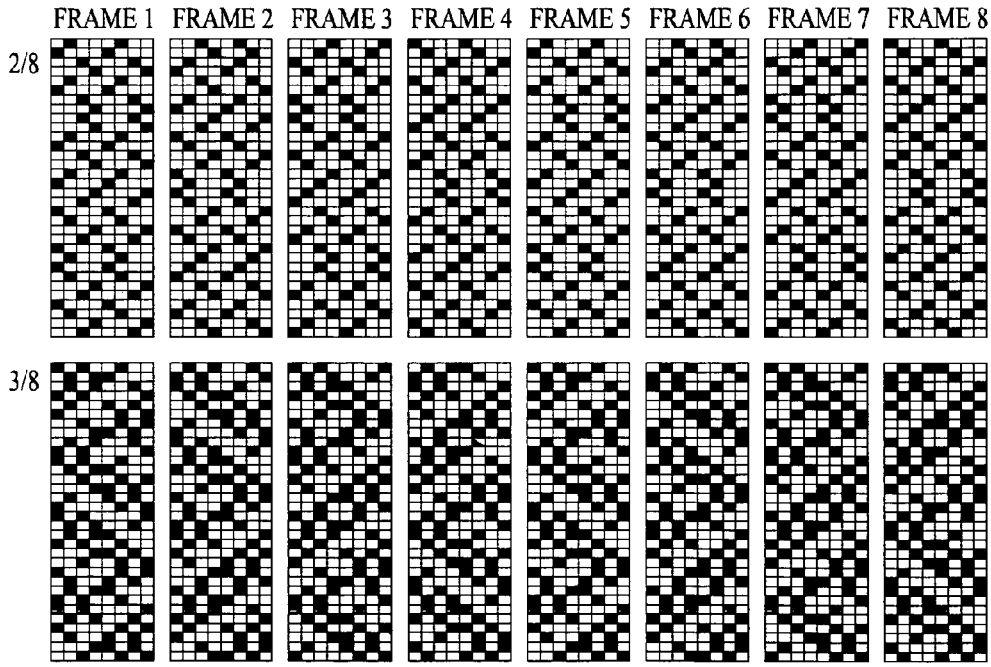
Figure 13C:
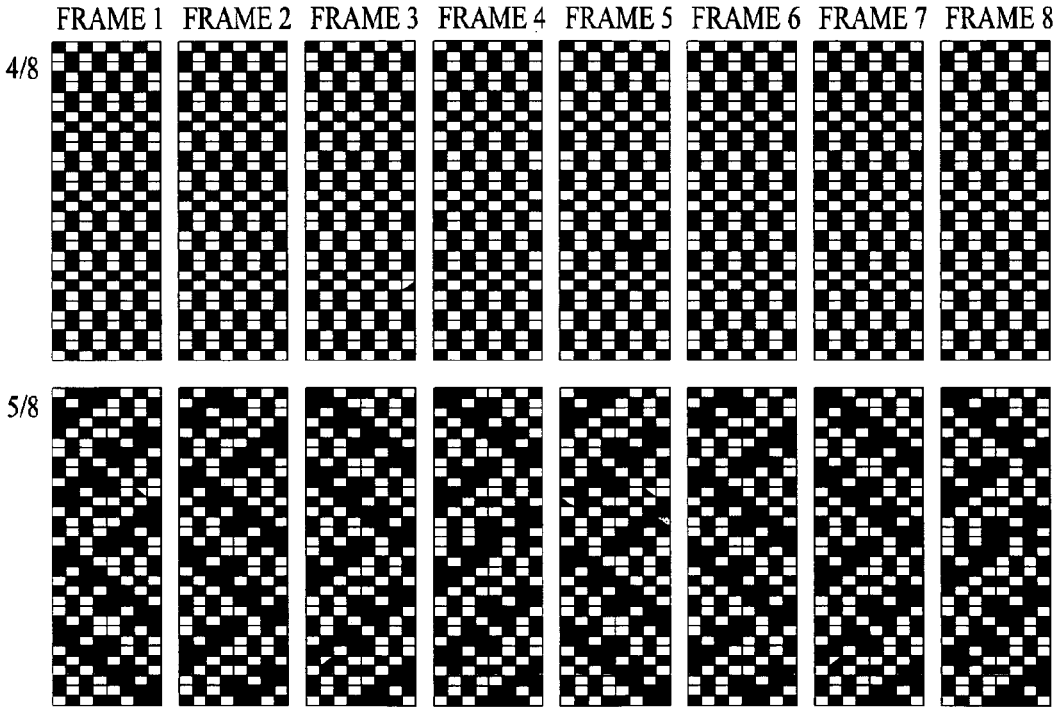
Figure 13D:
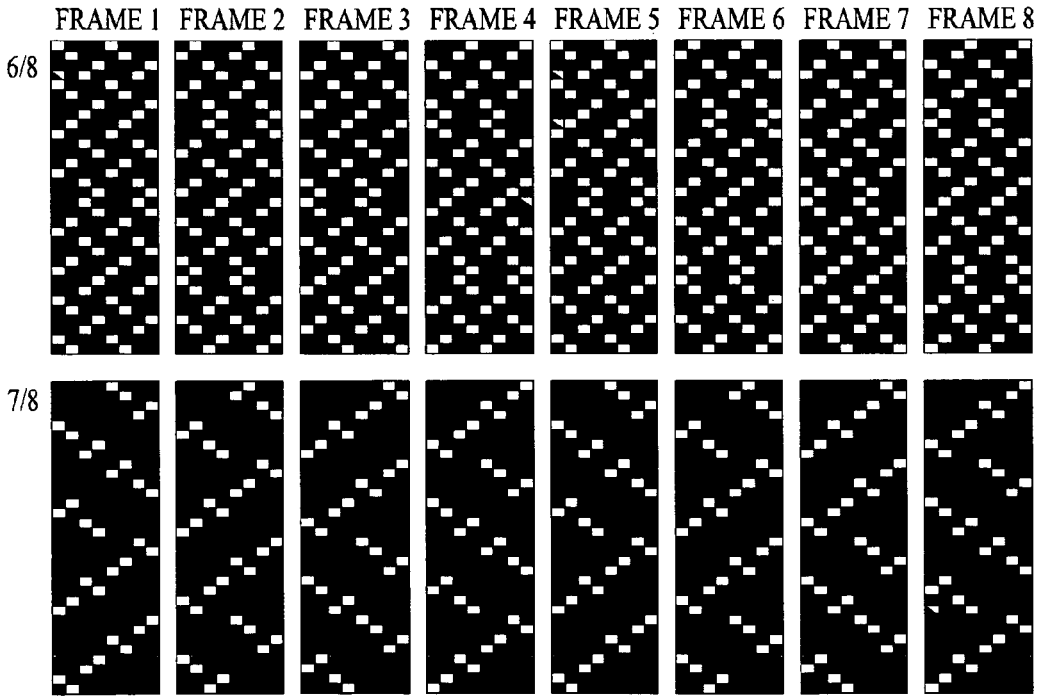

FIGS. 13A to 13C show FRC dither patterns according to a second embodiment of the present invention.

Referring to FIGS. 13A to 13C, the size of the FRC dither patterns according to the second embodiment of the present invention is 8 pixels x 32 pixels and compensation values "⅛", "⅔", "⅜", "⅝", "⅝", "⅝", "⅞" and "1" are added to or subtracted from input digital video data according to the number of pixels to which the compensation value is applied. In the dither patterns, red pixels indicate pixels to/from which "1" is added/subtracted and gray pixels indicate pixels to/from which "0" is added/subtracted. The dither pattern having the compensation value "1" is the dither pattern in which the compensation value "1" is applied to the pixels included in the dither pattern of 8 pixels×32 pixels and is omitted in the drawing.

These dither patterns satisfy the substantially same condition as the first embodiment. That is, as shown in FIGS. 13A to 13D, the dither pattern having the compensation value "I" includes J sub dither patterns which have the compensation value "I"and are different from one another in the patterns of the pixels to/from which the compensation value is added/subtracted. In such dither patterns, the arrangements of the sub dither patterns are different from one another in the J frames and the dither pattern having the same compensation value appears with the period of J frames.

Such dither patterns are applied to the boundary between the panel defect region and the non-defect region as shown in FIG. 12 such that the brightness of data can be finely corrected and data which will be displayed in the panel defect region can be compensated.

Figure 14:
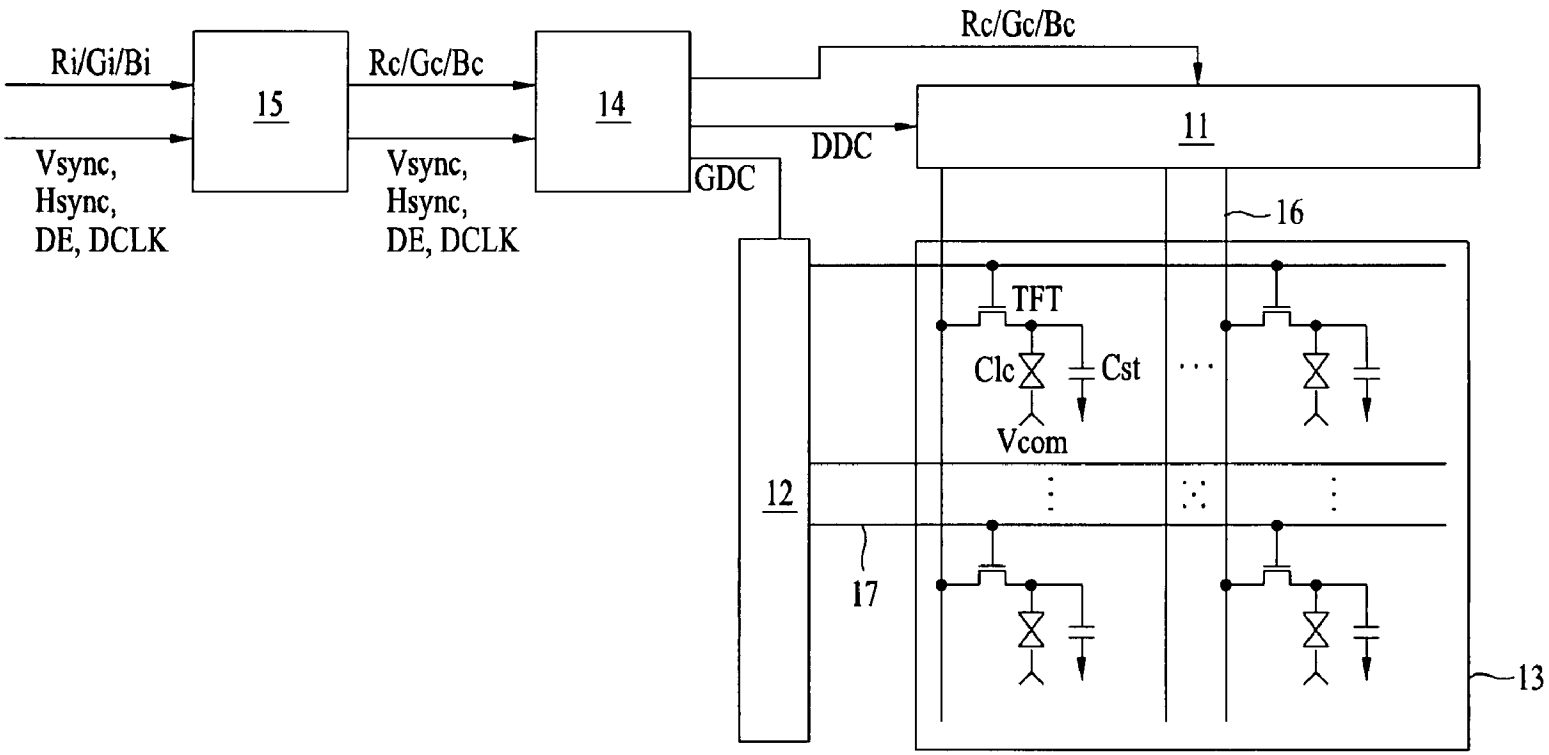
FIG. 14 is a view showing a liquid crystal display according to an embodiment of the present invention.

FIG. 14 is a view showing a liquid crystal display using the FRC compensation circuit of the present invention.

Referring to FIG. 14, the liquid crystal display according to the embodiment of the present invention includes a display panel 13 on which data lines 16 and gate lines 17 that cross each other and thin film transistors (TFTs) for driving liquid crystal cells Clc are formed at the crossings thereof, a FRC compensation circuit 15 for modulating digital video data Ri, Gi and Bi, which will be displayed in a boundary between a panel defect region and a non-defect region of the display panel 13, a data driving circuit 11 for supplying the modulated data Rc, Gc and Bc to the data lines 16, a gate driving circuit 12 for sequentially supplying scan signals to the gate lines 17, and a timing controller 14 for controlling the driving circuits 11 and 12.

The display panel 13 includes liquid crystal molecules filled between two substrates (a TFT substrate and a color filter substrate). The data lines 16 and gate lines 17 which are formed on the TFT substrate are perpendicular to each other. The TFTs formed at crossings between the data lines 16 and the gate lines 17 supply data voltages, which are supplied via the data lines 16 in response to the scan signals from the gate lines 17, to pixel electrodes of the liquid crystal cells Clc. On the color filter substrate, a black matrix, a color filter and a common electrode, all of which are not shown, are formed. Meanwhile, in an in-plane switching (IPS) mode or a fringe field switching (FFS) mode, the common electrode is formed on the TFT substrate rather than on the color filter substrate. Polarization plates having polarization axes perpendicular to each other are formed on the TFT substrate and the color filter substrate, respectively.

The compensation circuit 15 receives the digital video data Ri, Gi and Bi from a system interface, determines data which will be displayed in the boundary between the panel defect region and the non-defect region, maps the FRC dither patterns having the respective compensation value to the data of the boundary, and adds/subtracts the compensation values. The compensation circuit 15 will be described in detail later.

The timing controller 14 supplies the digital video data Rc, Gc and Bc received from the compensation circuit 15 to the data driving circuit 11 in synchronization with a dot clock DCLK and generates a gate control signal GDC for controlling the gate driving circuit 12 and a data control signal DDC for controlling the data driving circuit 11, using vertical and horizontal synchronization signals Vsync and Hsync, a data enable signal DE and the dot clock DCLK.

The data driving circuit 11 converts the digital video data Rc, Gc and Bc received from the timing controller 14 into analog gamma compensation voltages and supplies the analog gamma compensation voltages to the data lines 16 as the data voltages.

The gate driving circuit 12 sequentially supplies the scan signals for selecting horizontal lines to which the data voltages will be supplied, to the gate lines 17. The data voltages from the data lines 16 are simultaneously or sequentially to supplied to the liquid crystal cells Clc of one horizontal line in synchronization with the scan lines.

Figure 15:
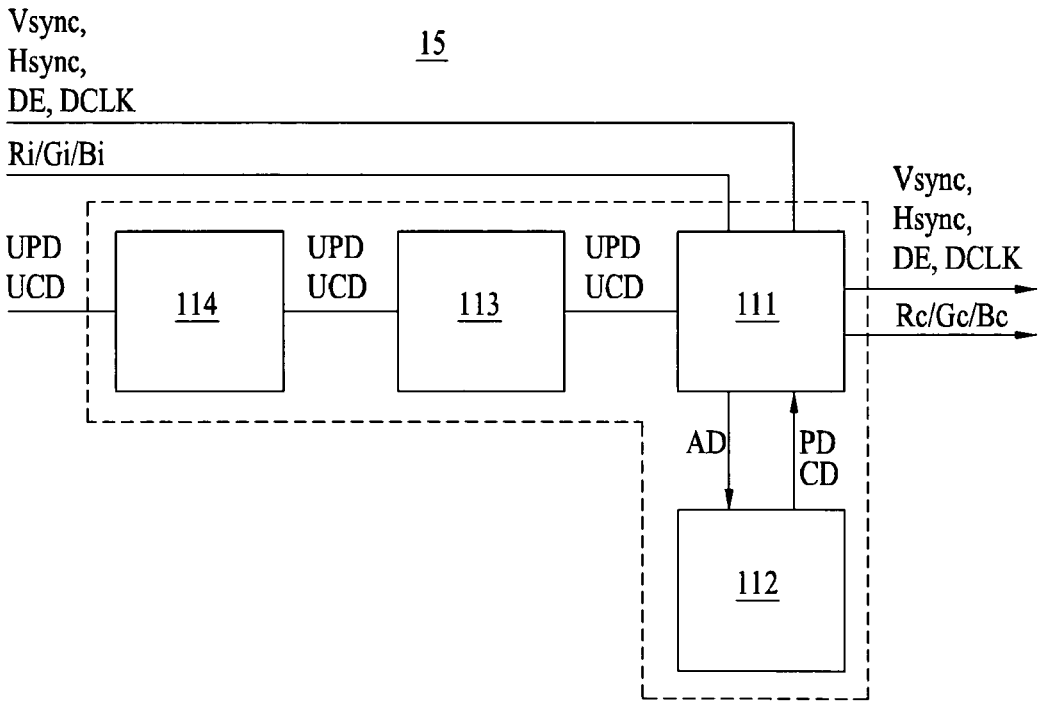
FIG. 15 is a view in detail showing a FRC compensation circuit shown in FIG. 14.

FIG. 15 is a view in detail showing the compensation circuit 15 shown in FIG. 14.

Referring to FIG. 15, the compensation circuit 15 includes an EEPROM 112 for storing positional data PD of the pixels of the boundary between the panel defect region and the non-defect region of the display panel 13 and compensation data for correcting the brightness of the boundary, a compensation unit 111 for modulating the digital video data Ri, Gi and Bi using the positional data PD and the compensation data CD stored in the EEPROM 112, an interface circuit 114 for performing communication between the compensation circuit 15 and an external system, and a register 113 for temporarily storing data which will be stored in the EEPROM 112 via the interface circuit 114.

The compensation data CD stored in the EEPROM 112 is optimized to another value according to the gray-level value and the display position of the data which will be displayed in the boundary. In order to optimize the compensation data CD and the positional data PD, a series of testing and compensation-value determining processes which repeatedly performs steps of supplying test data having different gray levels to a test panel, turning on the test panel according to the gray levels, measuring the brightness of each position in a state in which the test panel is turned on, adding/subtracting a compensation value for compensating for the brightness to/from data, supplying the data to the panel, and measuring the brightness again are performed in a manufacturing process.

The EEPROM 112 may be updated by data received from a ROM recorder connected to the interface circuit 114 via a user cable. That is, the positional data PD and the compensation data CD stored in the EEPROM 112 need to be updated due to a variation in process or a difference between applied models, and the user may store positional data UPD and compensation data UCD, both of which is desired to be updated, in the EEPROM 112 and correct the stored data, while communicating with the external system via the interface circuit 114. The EEPROM 112 includes a look-up table for selecting compensation data optimized according to the respective gray levels, according to a read address generated from the gray-level value and the display position of data which is currently being input.

The interface circuit 114 performs bi-directional communication between the compensation circuit 15 and the external system and transmits data using a communication standard protocol such as 12C.

The positional data UPD and compensation data UCD which are transmitted via the interface circuit 114 by the user are temporarily stored in the register 113.

The compensation unit 111 detects data which will be displayed in the boundary between the panel defect region and the non-defect region using the positional data (PD) and the compensation data (CD) stored in the EEPROM 112, maps the dither patterns shown in FIG. 8 or 13, to which the compensation values are applied pixel by pixel, to the data, adds/subtracts the compensation values to/from the data of the boundary, and generates the data Rc, Gc and Bc with the compensated brightness.

Figure 16:
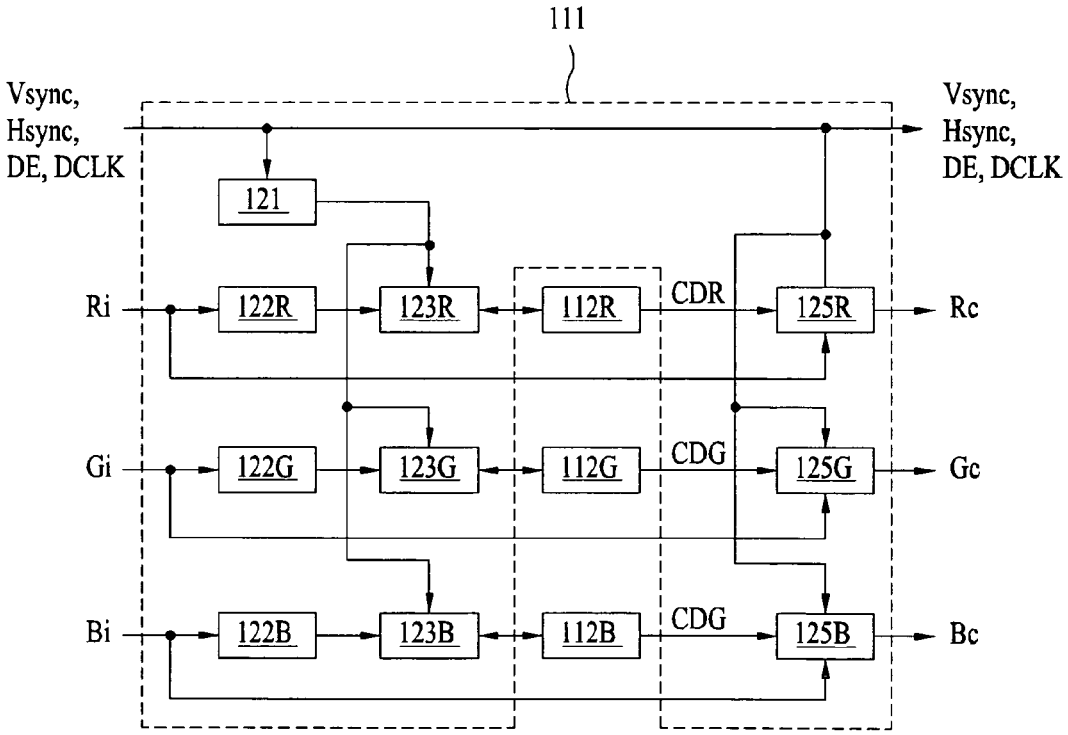
FIG. 16 is a view in detail showing a compensation unit shown in FIG. 15.

FIG. 16 is a view in detail showing the compensation unit 111 shown in FIG. 15.

Referring to FIG. 15, the compensation unit 111 includes a position determining unit 121, gray level determining units 122R, 122G and 122B, address generating units 123R, 123G and 123B and FRC control units 125R, 125G and 125B.

The EEPROMs 112R, 112G and 112B connected to the compensation unit 111 store the positional data PD of the pixels of the boundary and compensation data (CD) of the boundary, according to red (R), green (G) and blue (B).

The position determining unit 121 determines the display positions of the input data Ri, Gi and Bi on the liquid display panel 13 using the vertical and horizontal synchronization signal Vsync and Hsync, the data enable signal DE and the dot clock DCLK and supplies the result of determining the display positions of the input data Ri, Gi and Bi to the address generating units 123R, 123G and 123B.

The gray level determining units 122R, 122G and 122B analyze the gray levels of the digital video data Ri, Gi and Bi and supplies the gray level information of the data to the address generating units 123R, 123G and 123B.

The address generating units 123R, 123G and 123B compare the positional data stored in the EEPROMs 112R, 112G and 112B with the determined result of the positional determining unit 121, generates read address data on the basis of the compared result and the gray level information from the gray level determining units 122R, 122G and 122B, and supplies the address data to the EEPROMs 112R, 112G and 112B. In response to the address data, the EEPROMs 112R, 112G and 112B output compensation data corresponding to the data that will be displayed in the pixels of the boundary, and having compensation values that are optimized according to the gray levels.

The FRC control units 125R, 125G and 125B disperse the compensation data from the EEPROMs 112R, 112G and 112B to predetermined compensation pixels in the dither patterns, using the dither patterns shown in FIGS. 8 and 13, which are previously programmed, during a plurality of frame periods. The compensation value of the compensation data which is spatially/temporally dispersed by the dither patterns shown in FIGS. 8 and 13 is added/subtracted to/from the data of the pixels determined according to the dither patterns.

Figure 17:
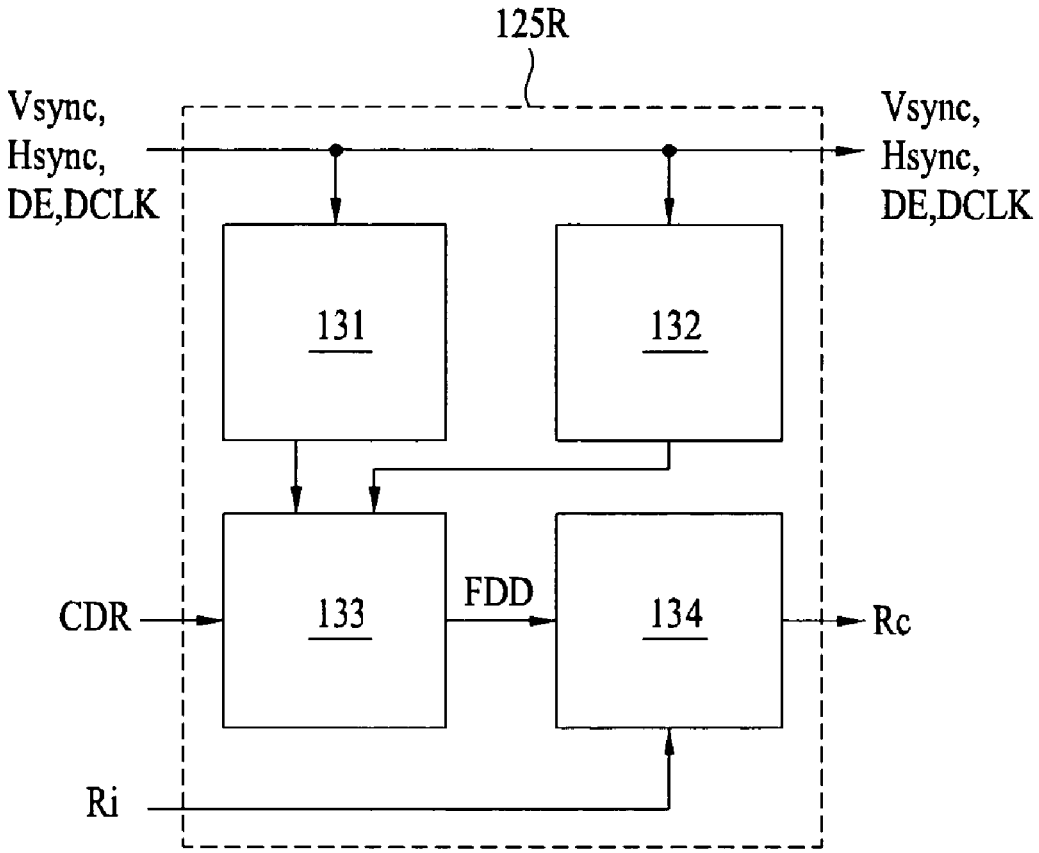
FIG. 17 is a view showing details of a FRC control unit shown in FIG. 16, for compensating for R data.

FIG. 17 is a view showing details of the FRC control unit 125R shown in FIG. 16, for compensating for R data.

Referring to FIG. 17, the FRC control unit 125R includes a compensation value determining unit 133, a frame number determining unit 131, a pixel position determining unit 132, and a calculator 134.

The compensation value determining unit 133 determines the pixel position and the number of frames of data, which is currently being input, on the basis of pixel information from the pixel position determining unit 132 and pixel number information from the frame number determining unit 131, disperses the R compensation value received from the EEPROM 112R to a plurality of pixels and a plurality of frames according to the dither patterns shown in FIGS. 8 and 13, and generates FRC data FDD.

The frame number determining unit 131 determines the number of frames using at least one of the vertical and horizontal synchronization signals Vsync and Hsync, the dot clock DCLK and the data enable signal DE. For example, the frame number determining unit 131 may detect the number of frames by counting the vertical synchronization signal Vsync.

The pixel position determining unit 132 determines the pixel position using at least one of the vertical and horizontal synchronization signals Vsync and Hsync, the dot clock DCLK and the data enable signal DE. For example, the pixel position determining unit 132 may detect the pixel position by counting the horizontal synchronization signal Hsync and the dot clock DCLK.

The calculator 134 increases/decreases the R data Ri, which is currently being input, to the FRC data FDD and generates corrected R data Rc.

Figure 1:
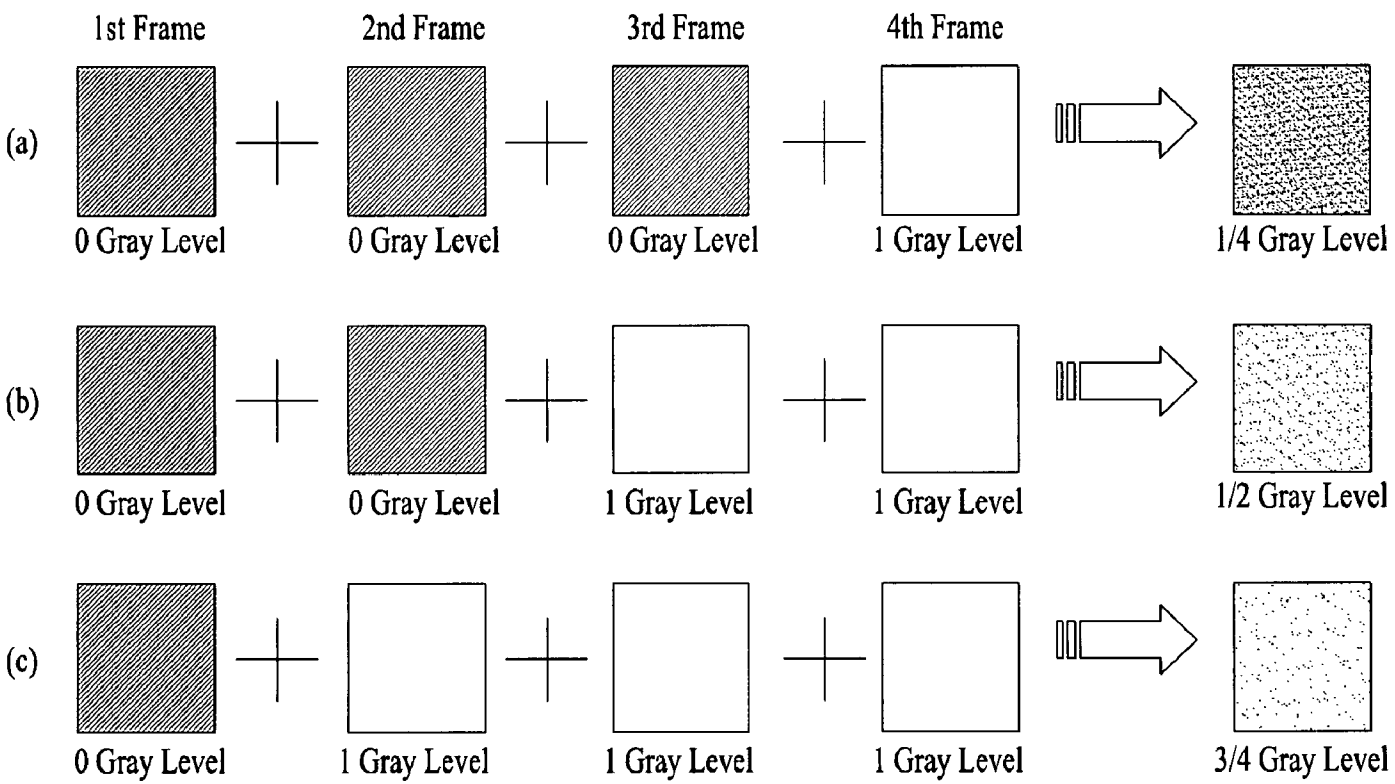
FIG. 1 Related Art
FIG. 1 is a view showing an example of a frame rate control (FRC) method.
Figure 2:
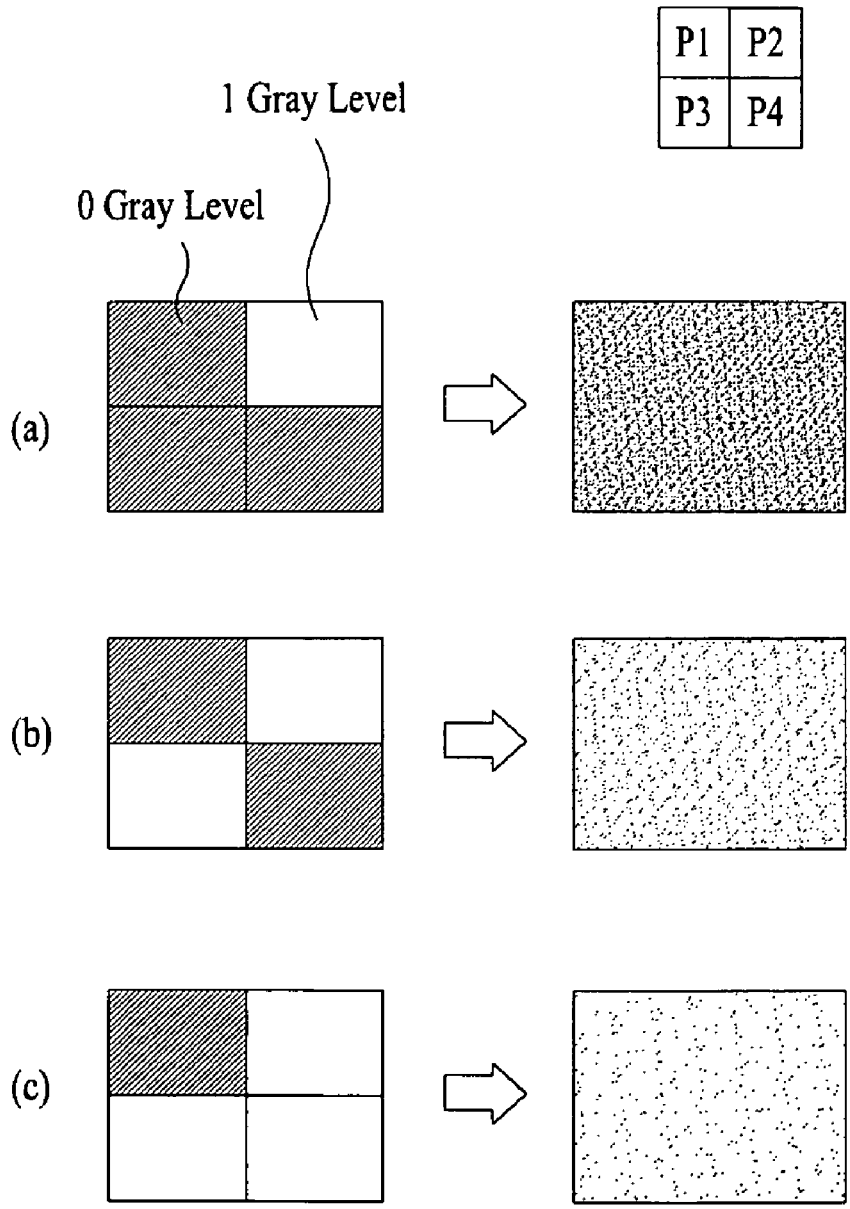
FIG. 2 Related Art
FIG. 2 is a view showing an example of a dithering method.
Figure 3:
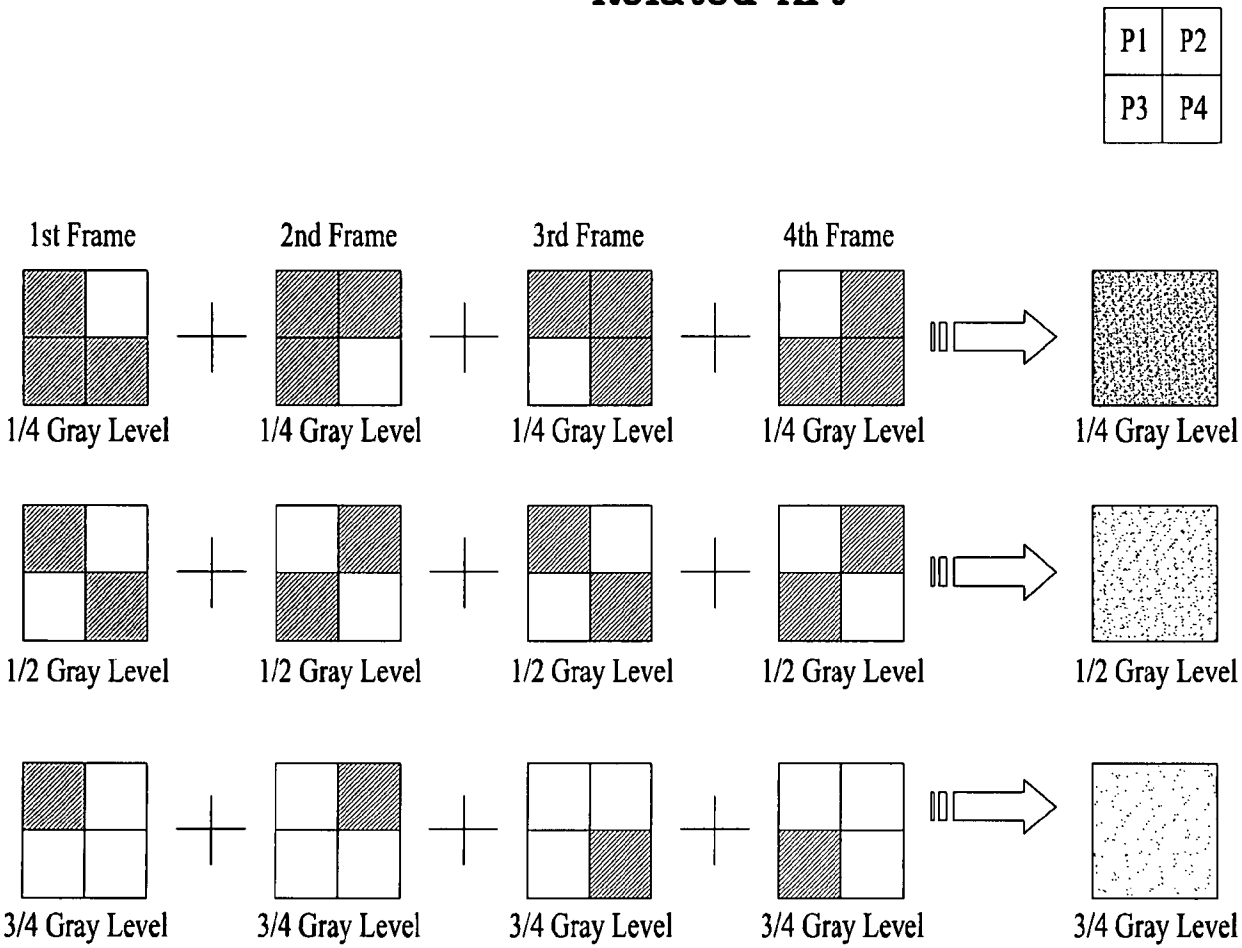
FIG. 3 Related Art
FIG. 3 is a view showing a FRC method using dither patterns shown in FIG. 2.
Figure 4:
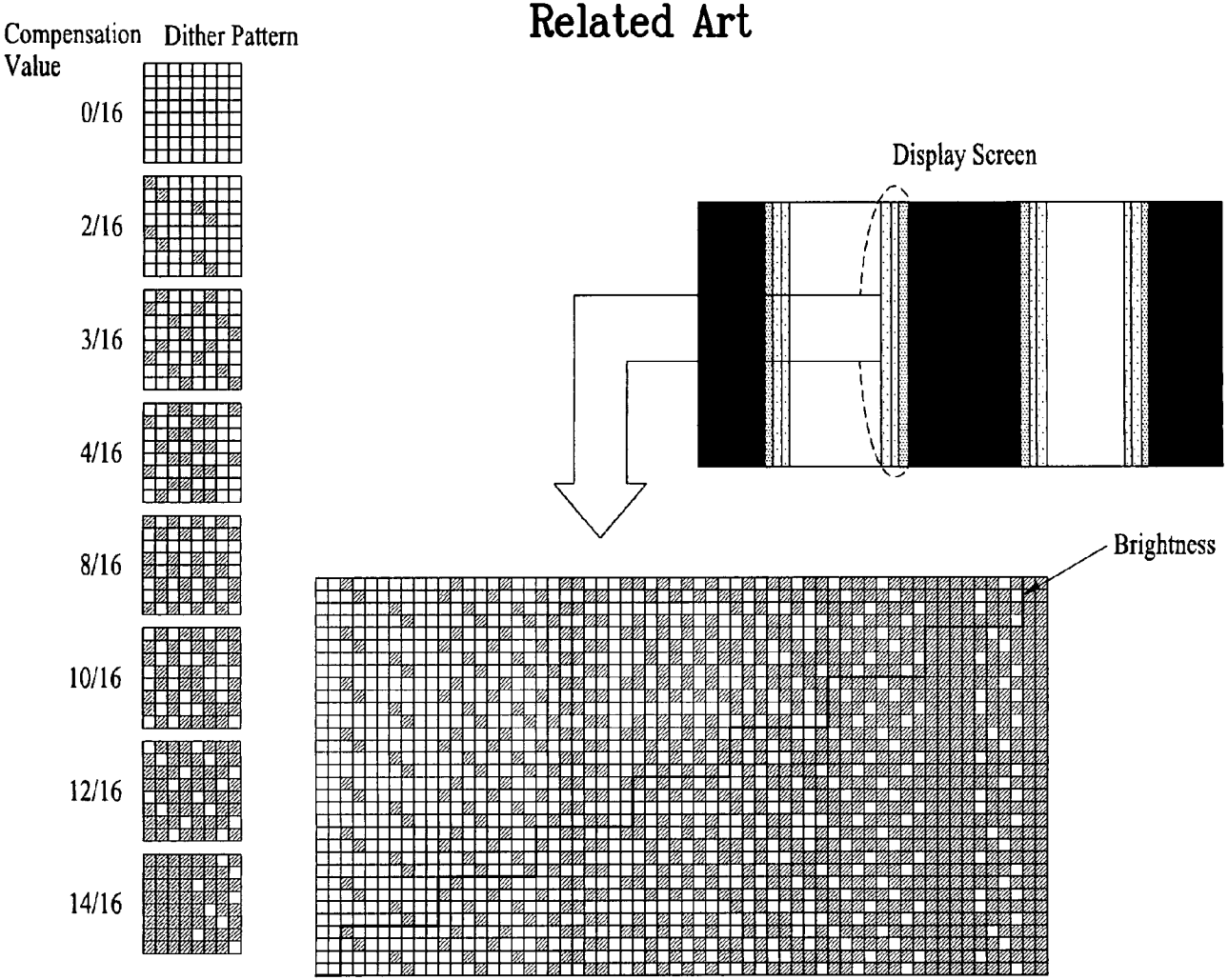
FIG. 4 Related Art
FIG. 4 is a view showing another example of a FRC method using dither patterns.
Figure 5A:
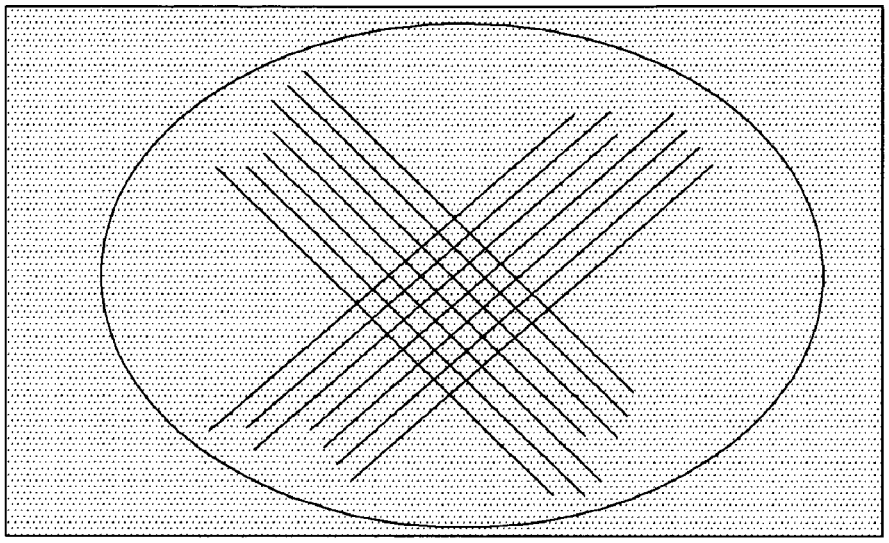
FIG. 5A Related Art
FIGS. 5A to 5C are views showing examples of a picture-quality defect region.
Figure 5B:
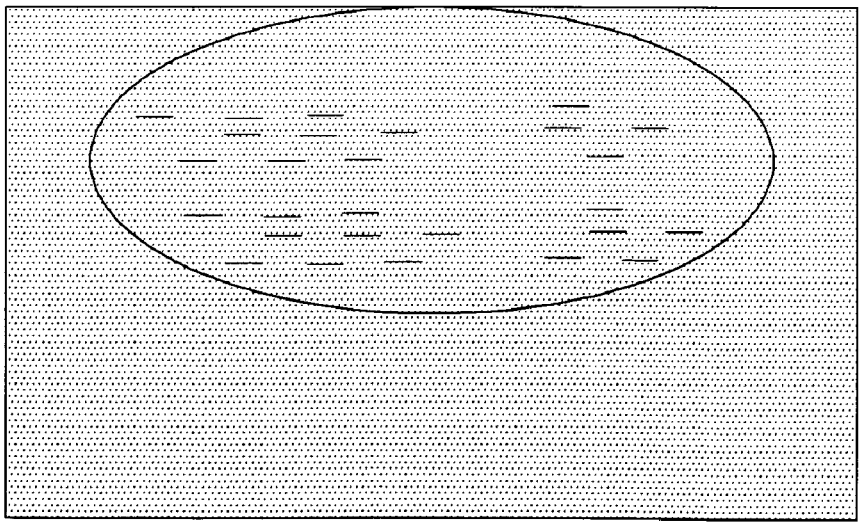
FIG. 5B Related Art
Figure 5C:
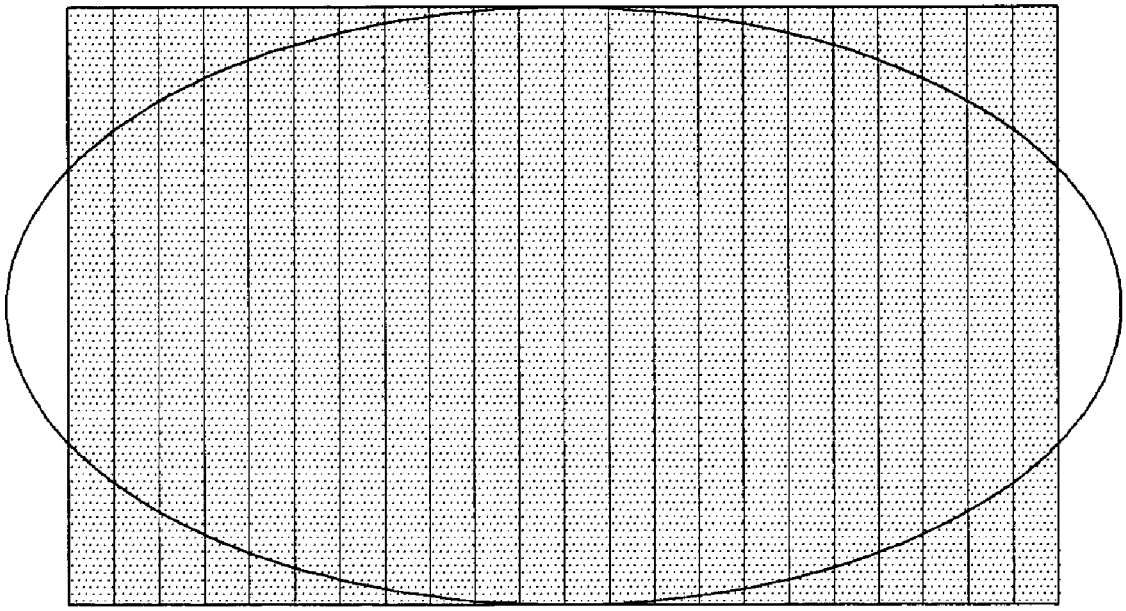
FIG. 5C Related Art
Figure 6:
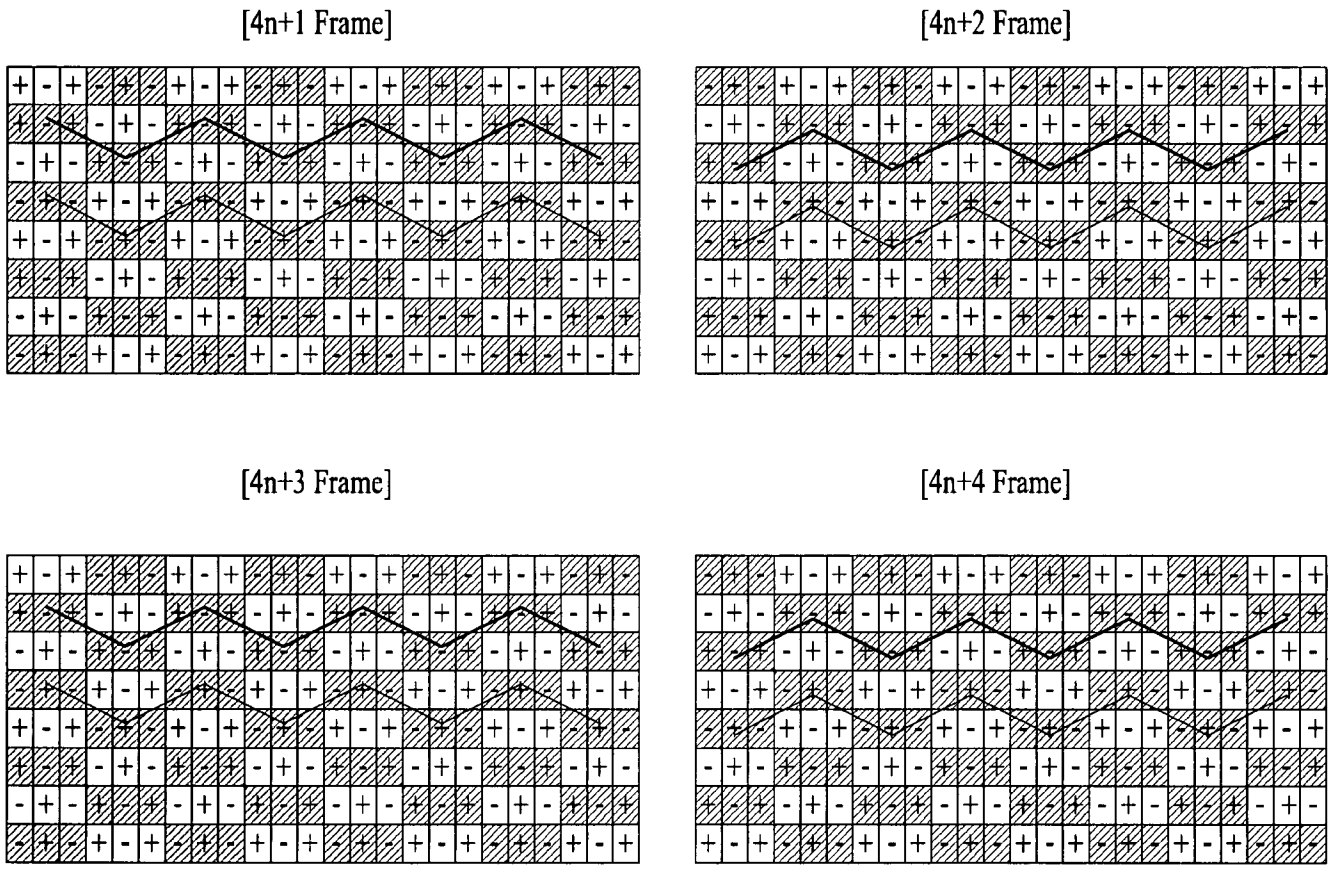
FIG. 6 Related Art
FIG. 6 is a view showing a horizontal-line pattern which appears at the time of compensation of a dither pattern having a gray level of 4n+2 (n is a natural number including 0)
Figure 7A:
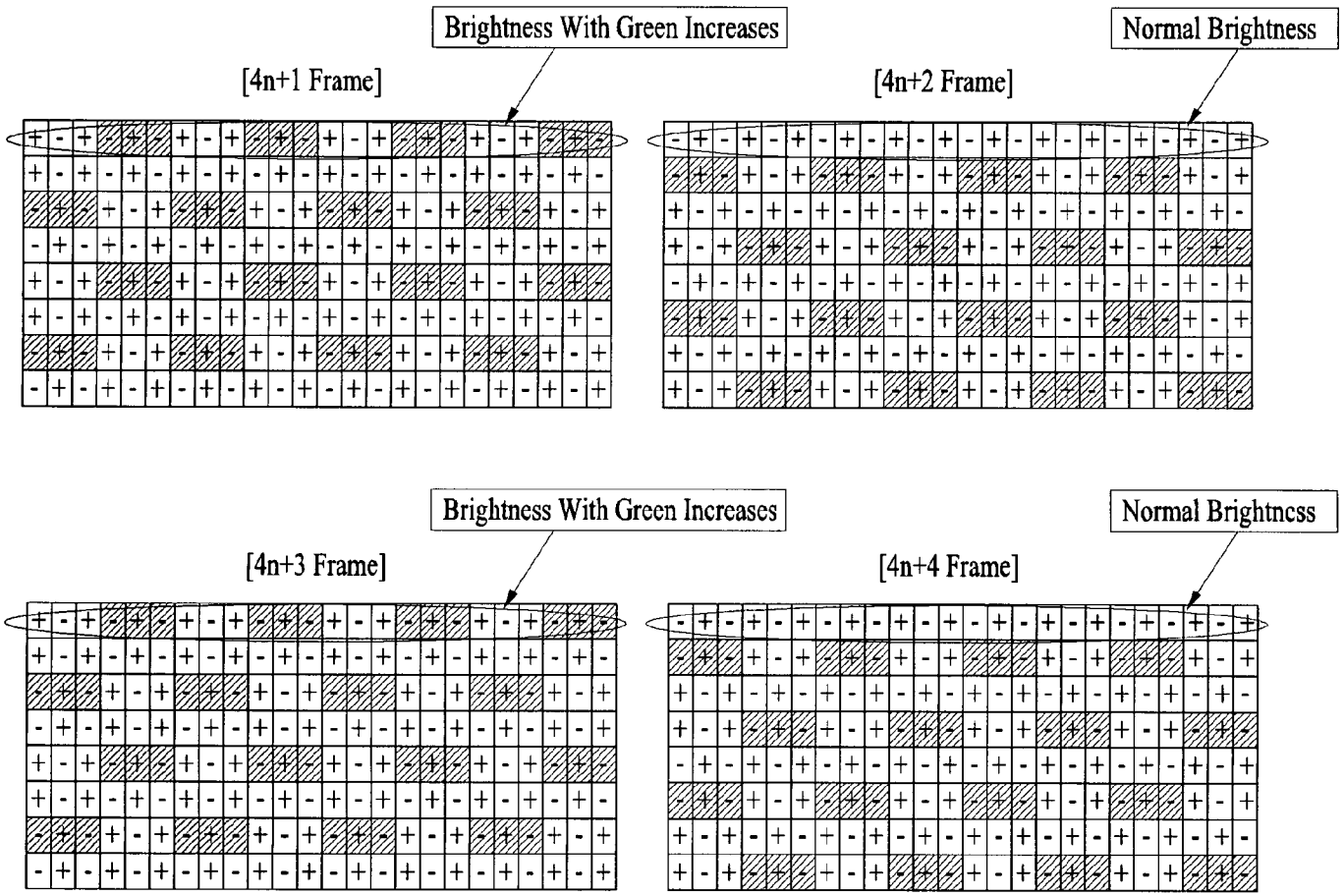
FIG. 7A Related Art
FIGS. 7A and 7B are views showing FRC flicker which is caused at the time of compensation of dither patterns having gray levels of 4n+1 and 4n+3, respectively.
Figure 7B:
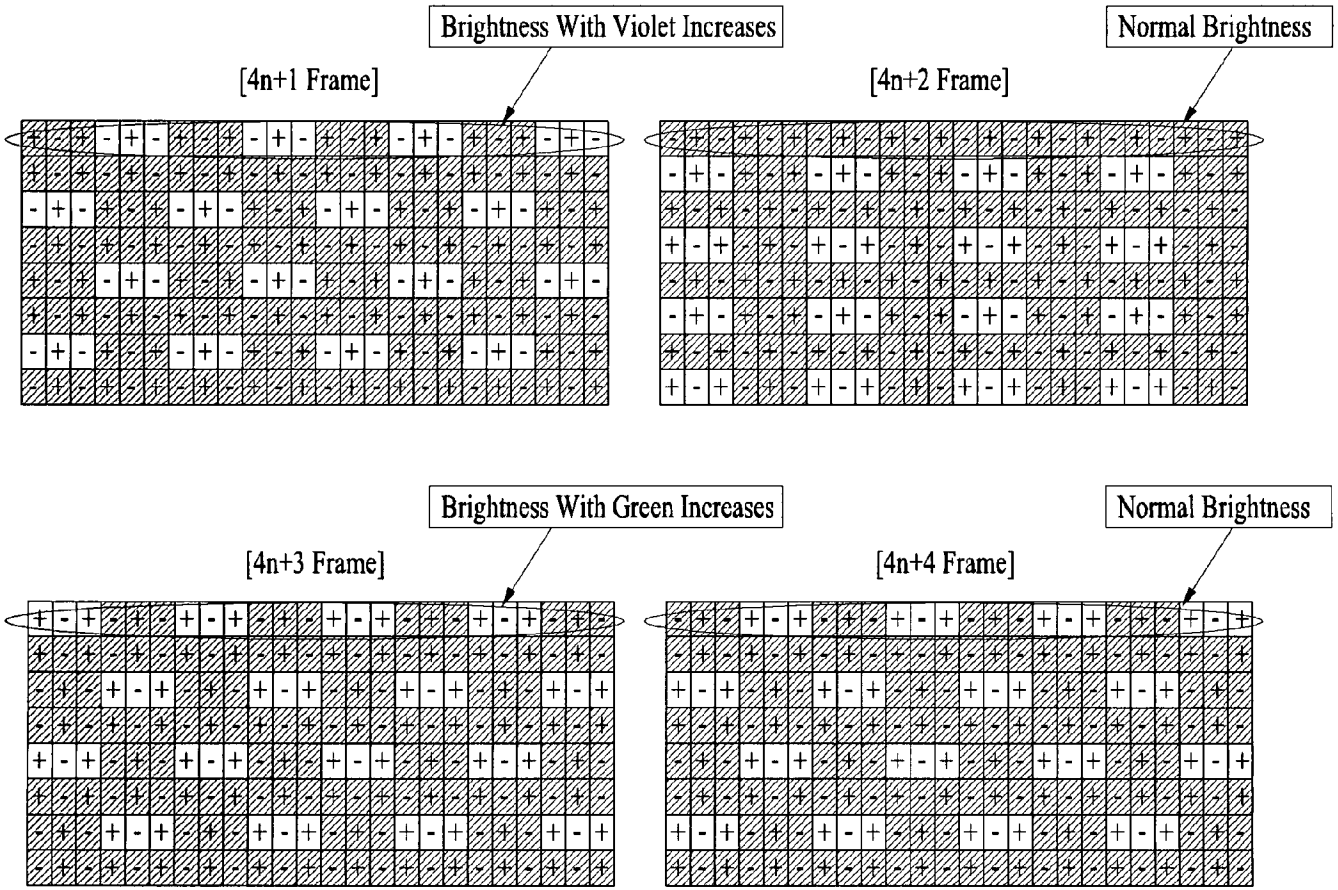
FIG. 7B Related Art

The FRC control units 125G and 125B shown in FIG. 6, which respectively compensate for G and B data, have the substantially same circuit configuration as the FRC control unit 125R and thus the detailed description thereof will be omitted.

Although the EEPROM is described as the memory for storing the positional data and the compensation data in the above-described embodiments, the present invention is not limited to the EEPROM and any memory which can update data may be used instead of the EEPROM. For example, the present invention may use an extended display identification data ROM (EDID ROM) instead of the EEPROM. The EDID ROM has been used for storing product information data such as variables and characteristics of a basic display device and a seller/manufacturer identification (ID) in flat panel displays.

Meanwhile, according to an experiment, when the dither pattern of the related art having a compensation value of which a numerator is an odd number, such as ⅛, ⅜, ⅝ and ⅞, is applied in order to suppress the horizontal-line pattern, the horizontal-line pattern may still appear or a phenomenon that horizontal-line patterns appears may become serious. Accordingly, in the related art dithering methods, the dither patterns having the compensation value of which the numerator is the odd number are not used. By contrast, when the data of a region in which the horizontal-line pattern appears is compensated using the dither patterns shown in FIGS. 8A to 8C and the dither patterns shown in FIGS. 13A to 13D, the horizontal-line pattern does not appear even in the dither pattern having the compensation value of which the numerator is the odd number. Accordingly, the dither patterns according to the embodiments of the present invention may be applied even at the time of compensating for data of a picture-quality defect region, which appears in the form of a horizontal line, in addition to the boundary and the panel defect region.

Further, when using related art dither patterns, an FRC flicker is caused due to a data bunching phenomenon in a specific data pattern. However, when the compensation is performed using the dither patterns shown in FIGS. 8A to 8C and the dither patterns shown in FIGS. 13A to 13D, the periodicity of the dither pattern is increased and flicker is not caused.

As described above, according to an apparatus and method for controlling picture quality of a flat panel display of the present invention, it is possible to minimize the same pattern from being repeated in a FRC dither pattern in the vertical/horizontal direction. In addition, by changing the arrangement of sub dither patterns in the dither pattern in each frame period by frame rolling, the periodicity of the dither patterns is increased and a boundary between the dither patterns does not appear.

Further, it is possible to finely compensate for brightness in a boundary between a panel defect region and a non-defect region, by applying FRC using the dither patterns.

Further, it is possible to suppress a thin horizontal-line pattern and FRC flicker, by increasing the periodicity of the dither patterns.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents

What is claimed is:

1. An apparatus for controlling picture quality of a flat panel display including a panel defect region and a non-defect region, the apparatus comprising:

a position determining unit which determines a display position of digital video data;

a gray-level determining unit which analyzes a gray level of the digital video data and outputs a gray level information according to the analyzing result; and a FRC (Frame Rate Control) control unit which determines a plurality of dither patterns based on a compensation value, for compensating for brightness in a boundary between the panel defect region and the non-defect region, according to the determined result of the position determining unit and the gray level information and disperses the compensation value using a plurality of dither patterns in the boundary during a plurality of frame periods, wherein each of the plurality of dither patterns includes a plurality of sub dither patterns, and wherein the compensation value of each of the dither patterns is equal to that of each of the sub dither patterns included in each of the dither patterns and the sub dither patterns included in each of the dither patterns are different from one another in the positions of compensation pixels.

2. The apparatus according to claim 1, wherein, if the compensation value is "I"(wherein "I" is an integer) and the number of sub dither patterns is "J"(wherein "J" is an integer), the dither pattern having the compensation value of "I" includes J sub dither patterns which have the compensation value of "I" and are different from one another in the positions of the compensation pixels, and the arrangements of the sub dither patterns are different in J frames.

3. The apparatus according to claim 2, wherein the arrangements of the sub dither patterns are vertically shifted in each of a predetermined number of frames by frame rolling.

4. The apparatus according to claim 2, wherein the arrangements of the sub dither patterns are repeated in the unit of J frame periods.

5. The apparatus according to claim 1, wherein each of the dither patterns has a size of 8 pixels×32 pixels or more.

6. The apparatus according to claim 1, further comprising a memory for storing the compensation value and positional data indicating pixel positions of the boundary, wherein the FRC control unit reads the compensation value by referring to the memory.

7. The apparatus according to claim 6, wherein the FRC control unit disperses the compensation value to the plurality of compensation pixels and the frame periods according to the dither patterns and generates FRC data.

8. The apparatus according to claim 7, further comprising a calculator which adds/subtracts the FRC data to the data for display at the boundary.

9. The apparatus according to claim 1, wherein the compensation value varies according to the gray level information of the digital video data to be displayed in the boundary.

* * * * *